US009609898B2

(12) United States Patent
Kanayama

(10) Patent No.: US 9,609,898 B2
(45) Date of Patent: Apr. 4, 2017

(54) GARMENT FOR LAYERING, AND OUTWEAR AND INNER LAYER WEAR TO BE USED IN GARMENT FOR LAYERING

(75) Inventor: Yotaro Kanayama, Kobe (JP)

(73) Assignee: finetrack, Kobe-shi (JP)

( * ) Notice: Subject to any disclaimer, the term of this patent is extended or adjusted under 35 U.S.C. 154(b) by 88 days.

(21) Appl. No.: 13/811,754

(22) PCT Filed: Jun. 30, 2011

(86) PCT No.: PCT/JP2011/065083

§ 371 (c)(1),
(2), (4) Date: Jan. 23, 2013

(87) PCT Pub. No.: WO2012/014626

PCT Pub. Date: Feb. 2, 2012

(65) Prior Publication Data

US 2013/0117903 A1 May 16, 2013

(30) Foreign Application Priority Data

Jul. 26, 2010 (JP) ..... 2010-167268
Jun. 22, 2011 (JP) ..... 2011-138589

(51) Int. Cl.
*A41D 1/00* (2006.01)
*A41D 27/28* (2006.01)
*A41D 31/02* (2006.01)

(52) U.S. Cl.
CPC ..... *A41D 1/00* (2013.01); *A41D 27/28* (2013.01); *A41D 31/02* (2013.01)

(58) Field of Classification Search
CPC ... A41D 1/00; A41D 1/04; A41D 1/08; A41D 13/0015; A41D 13/00;
(Continued)

(56) References Cited

U.S. PATENT DOCUMENTS 4,608,715 A * 9/1986 Miller et al. ..... 2/1
4,868,928 A * 9/1989 Norvell ..... A41D 31/02 2/272

(Continued)

FOREIGN PATENT DOCUMENTS

JP 33-14733 Y 9/1958
JP 49-9345 A 1/1974

(Continued)

OTHER PUBLICATIONS

Office Action dated Jul. 27, 2012 in corresponding Japanese Patent Application No. 2011-138589.

(Continued)

*Primary Examiner* — Khaled Annis
(74) *Attorney, Agent, or Firm* — Knobbe Martens Olson & Bear LLP

(57) ABSTRACT

The object of the invention to provide a garment for layering having better ventilation performance than conventional counterparts, and an outerwear and an inner-layer wear to be used in this garment for layering. The present invention provides a garment for layering including an outerwear, and one or more inner-layer wears worn inside the outerwear, the outerwear and at least one inner-layer wear having a vent that can be opened and closed.

8 Claims, 8 Drawing Sheets

(58) Field of Classification Search
CPC ..... A41D 13/0053; A41D 13/1245; A41D 27/00; A41D 27/28; A41D 3/00; A41D 31/02; A41D 2400/20; A41D 2400/62; A41B 1/00; A41B 1/08; A41B 9/06
USPC ..... 2/69, 77, 113, 115, 272, 78.1
See application file for complete search history.

(56) References Cited

U.S. PATENT DOCUMENTS

| | | | | |
|---|---|---|---|---|
| 5,498,472 | A * | 3/1996 | Gold | 428/102 |
| 5,727,256 | A | 3/1998 | Rudman | |
| 5,752,277 | A * | 5/1998 | van der Sleesen | 2/69 |
| 6,085,353 | A * | 7/2000 | van der Sleesen | 2/69 |
| 6,125,472 | A * | 10/2000 | Nakagawa | 2/115 |
| 6,339,845 | B1 * | 1/2002 | Burns et al. | 2/243.1 |
| 7,043,766 | B1 * | 5/2006 | Foreman | A41B 9/06 2/69 |
| 7,540,037 | B1 * | 6/2009 | Bittler et al. | 2/69 |
| 7,678,718 | B2 * | 3/2010 | Harris et al. | 442/310 |
| 2004/0133962 | A1 * | 7/2004 | Baumel | 2/108 |
| 2004/0237169 | A1 * | 12/2004 | Wood et al. | 2/94 |
| 2005/0172381 | A1 * | 8/2005 | Bush et al. | 2/249 |
| 2008/0196140 | A1 * | 8/2008 | Mayerson et al. | 2/84 |
| 2012/0096622 | A1 * | 4/2012 | Johnson | 2/93 |

FOREIGN PATENT DOCUMENTS

| | | | |
|---|---|---|---|
| JP | 56-69614 | U | 6/1981 |
| JP | 7-503286 | A | 4/1995 |
| JP | 2005-163227 | A | 6/2005 |
| JP | 2008-38324 | A | 2/2008 |
| JP | 2008-038324 | A | 2/2008 |
| KR | 10-0964968 | | 6/2010 |
| WO | 93/05671 | | 4/1993 |

OTHER PUBLICATIONS

Search Reported mailed Aug. 16, 2011 in corresponding International Applicatin No. PCT/JP2011/065083.

Office Action issued Apr. 25, 2014 in corresponding Chinese Patent Application No. 201180034768.5.

Office Action issued Jun. 28, 2016 in corresponding KR Application No. 10-2013-7000531.

Office Action issued Nov. 20, 2015 in corresponding KR Application No. 10-2013-7000531.

Office Action issued Dec. 22, 2014 in corresponding Chinese application No. 201180034768.5.

Office Action issued Nov. 18, 2016 in corresponding KR Application No. 10-2016-7020832.

* cited by examiner

GARMENT FOR LAYERING, AND OUTWEAR AND INNER LAYER WEAR TO BE USED IN GARMENT FOR LAYERING

CROSS-REFERENCE TO RELATED APPLICATIONS

This application is the U.S. National Phase under 35. U.S.C. §371 of International Application PCT/JP2011/065083, filed Jun. 30, 2011, which claims priority to Japanese Patent Application No. 2010-167268, filed Jul. 26, 2010 and Japanese Patent Application No. 2011-138589, filed Jun. 22, 2011. The disclosures of the above-described applications are hereby incorporated by reference in their entirety. The International Application was published under PCT Article 21(2) in a language other than English.

TECHNICAL FIELD

The present invention relates to a garment for layering including an outerwear, and one or more inner-layer wears worn inside the outerwear, and to the outerwear and the inner-layer wear to be used in this garment for layering. More particularly, it relates to a garment for layering having improved ventilation performance when worn during exercises such as hiking, mountain climbing, jogging and the like, and to the outerwear and the inner-layer wear to be used in this garment for layering.

BACKGROUND ART

Outerwears having vents that can be opened and closed in portions from under the armpits to the sides of the waist, or in the chest part, are conventionally known. These vents provide ventilation for the wearer of the outerwear to adjust the temperature or moisture.

A garment having a vent hole near the collar in the back body to have a ventilation function is known (see, for example, Patent Document 1). In this Patent Document 1, a vent hole is formed near the collar in the back body of an outerwear such as a jumper, jacket, coat, windbreaker, and the like, to remove heat and moisture from inside the garment.

PRIOR ART DOCUMENTS

Patent Documents

Patent Document 1: JP-A-2005-163227

SUMMARY OF THE INVENTION

Problems to be Solved by the Invention

However, it was sometimes difficult to quickly deal with rapid changes in body temperature or moisture inside the garment for a better condition only by opening and closing vents in the outerwear as conventionally done. For example, in activities such as hiking and mountain climbing, several types of clothing are worn in layers so that the wearer can adjust in accordance with changing mountain weather conditions. For example, a base layer on the skin, a mid layer as an intermediate garment, and an outerwear or the like are commonly worn in layers. When dressed in layers like this, the wearer may not be able to quickly lower the body temperature that has gone up, or dry up sweat, when desired, only by manipulating the vents in the outerwear as conventionally done, and as a result, there were sometimes undesirable situations where the wearer was exhausted.

When the temperature or moisture condition could hardly be improved by opening or closing the vents in the outerwear, another measure that was commonly taken was to take off the outerwear. However, an action of taking off an outerwear can be troublesome itself. Furthermore, taking off the outerwear during hiking or mountain climbing, etc. involves stopping, putting down a backpack or the like, taking off the outerwear, and putting the removed outerwear in the backpack, putting on the backpack again, etc., which required time and trouble and was a highly-wasteful motion. In a dangerous route on cliffs or rocks, the wearer cannot take off the outerwear since the action of removing clothing itself may be dangerous. In adverse weather conditions, the wearer may simply not be able to take off the outerwear. Also, during rock climbing, it is hard to take off the outerwear because the climber wears a harness.

In other exercises such as jogging, the action of removing an outerwear was a wasteful motion, because the wearer had to stop the exercise such as jogging.

The present invention was made in view of the problems described above, and it is an object of the invention to provide a garment for layering having better ventilation performance than conventional counterparts, and an outerwear and an inner-layer wear to be used in this garment for layering.

Means for Solving the Problems

To solve the above problems, the present invention provides a garment for layering including an outerwear, and one or more inner-layer wears worn inside the outerwear, the outerwear and at least one inner-layer wear having a vent that can be opened and closed.

With this construction, the outerwear and the inner-layer wear have a vent that can be opened and closed, so that the body temperature can be lowered (cooled down) quickly, or sweat can be dried up quickly (relative moisture inside the clothing system can be lowered), by opening these vents. The invention can thus provide a garment for layering with remarkably improved ventilation effect as compared to a conventional system in which only the outerwear has a vent.

As one embodiment of the invention, the outerwear having a vent and the inner-layer wear having a vent should preferably be worn upon one another (layered). As one embodiment of the invention, another garment made of a breathable fabric may be worn between the outerwear having a vent and the inner-layer wear having a vent.

In the invention, the vent of the outerwear should preferably be positioned to coincide with or close to the vent of at least one inner-layer wear worn under the outerwear when the clothing system is worn. Being "close to" includes being substantially at the same position. It is a relative positional relationship between the vents with which the ventilation function can be exploited. The vents may be positioned relative to each other so as to overlap each other only partially. The respective vents need not have the same shape and size. The opening shape and size of the respective vents when opened need not be the same. For ease of opening and closing, and for ease of temperature and moisture adjustment, the respective vents should preferably be located or designed such that their openings will coincide with or be close to each other, or largely overlap each other, when the clothing system is worn. The vents may be designed to be parallel to each other when the clothing system is worn to make the opening and closing operation easier, and to achieve better ventilation performance since the openings will overlap each other when the vents are opened. Alternatively, the vents may be designed to cross each other, instead of being parallel.

In the invention, the vent of the outerwear should preferably be positioned in a front part thereof, and the vent of the inner-layer wear should preferably be positioned in a front part thereof so as to correspond to the position of the vent of the outerwear.

With this construction, as the vents are each positioned in the respective front parts, they are subjected to air currents or wind from the front, so that the body temperature can be lowered or sweat can be dried up more quickly. While at least one vent may be provided in the front part, another vent may be provided further in a side part of the garments, or the vent may be provided so as to extend from the front part to the side part.

If the vents are to be provided in the respective front parts, they should preferably be provided there except for parts from shoulders to armpits. This is because, if vents are provided in portions from shoulders to armpits, around the hip or in the back of the garments, the ventilation effect will presumably be low when a sack or backpack is being carried.

In one embodiment of the invention, the clothing system includes one inner-layer wear, and while the inner-layer wear that is worn under the outerwear has a vent, one or two base layers worn under the inner-layer wear does/do not have a vent. Thereby, sweat on the skin can be wicked away by one or two base layers and the moisture in the base layer(s) can be dried up quickly through the vents in the outerwear and the inner-layer wear.

In one embodiment of the invention, the clothing system includes two inner-layer wears, and while a first inner-layer wear worn under the outerwear has a vent and a second inner-layer wear worn under the first inner-layer wear has a vent, one or two base layers worn under the second inner-layer wear does/do not have a vent. Thereby, sweat on the skin can be wicked away by one or two base layers and the second inner-layer wear, and the moisture in the base layer(s) and the second inner-layer wear can be dried up quickly through the vents in the outerwear and the first and second inner-layer wears. The two base layers may be configured by, for example, a first base layer directly contacting the skin and made of a water-repellent fabric, and a second base layer worn on the former. This second base layer and the second inner-layer wear may be made of a fabric capable of retaining heat, wicking sweat away, and adjusting moisture. When one base layer is provided, it may be made of a fabric having, for example, a water-repellent layer on the side directly contacting the skin, and a sweat wicking layer on the side of the inner-layer wear.

Another aspect of the present invention is an outerwear to be used in the garment for layering described above, having a vent that can be opened and closed.

Another aspect of the present invention is an inner-layer wear to be used in the garment for layering described above, having a vent that can be opened and closed.

Another aspect of the present invention is an inner-layer wear worn between an outerwear having a vent that can be opened and closed and skin, the inner-layer wear having a vent that can be opened and closed.

With this construction, as the outerwear and the inner-layer wear have a vent, the body temperature can be lowered (cooled down) quickly, or sweat can be dried up quickly (relative moisture inside the clothing system can be lowered). Therefore the ventilation effect can be remarkably improved as compared to a conventional system in which only the outerwear had a vent.

In the invention, the vent of the inner-layer wear should preferably be positioned to coincide with or close to the vent of the outerwear when both garments are worn. The position of the vent in the inner-layer wear should preferably be determined such that it can be opened and closed by opening the vent in the outerwear. With this construction, the wearer can open the vent in the outerwear and insert his/her hand into the opening to open the vent in the inner-layer wear, so that the vent in the inner-layer wear can be opened and closed simply and quickly without taking off the outerwear.

Figure 1:
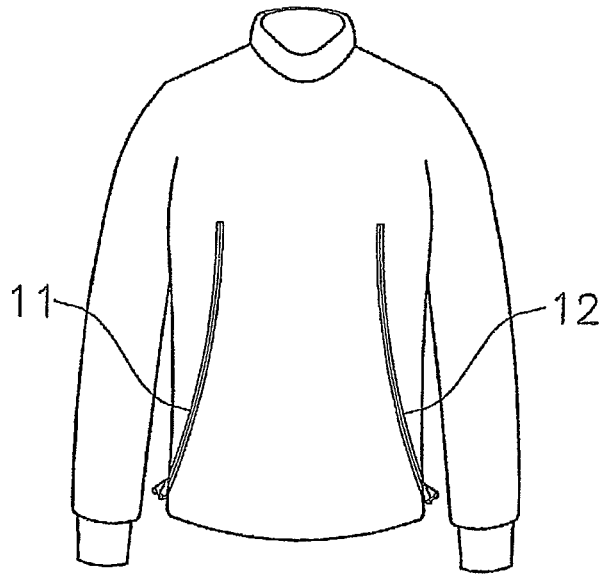
FIG. 1 is a diagram illustrating an example of the shape and position of vents.

MODE FOR CARRYING OUT THE INVENTION (Outerwear and Inner-Layer Wear)

The outerwear should preferably have various functions including, for example, but not particularly limited to, protection from cold, wind, and water, and resistance to rain. The inner-layer wear is configured by a base layer on the skin and a mid layer worn between the base layer and the outerwear. The base layer and the mid layer may be configured by clothing having various different functions to serve their purposes, or may be configured by a plurality of garments worn together depending on needs. Examples of functions the base layer may have include water repellency, heat retention, sweat wicking, and moisture adjustment, etc. For example, a first base layer having water repellency and a second base layer providing heat retention, sweat wicking, and moisture adjustment, may be worn either alone or in layers as the base layer. Examples of functions the mid layer may have include heat retention, sweat wicking, protection from wind, moisture permeability, and protection from water, etc. For example, a first mid layer providing heat retention and sweat wicking, and a second mid layer providing protection from wind, heat retention, and waterproof moisture permeability may be worn either alone or in layers as the mid layer. The base layer and the mid layer are not limited to those having the functions mentioned above. Some of the functions may be omitted, or other functions may be added in accordance with the purposes of use.

The outerwear and the inner-layer wear are not limited to clothing for upper body, and may be clothing for lower body such as tights or trousers, for example, or for the whole body. The outerwear for lower body may be, for example, thermal, windproof, and waterproof trousers, and the inner-layer wear for lower body may be, for example, tights, leggings, half pants, etc.

The thread materials or sewing techniques of the outerwear, inner-layer wear (mid layer), and base layers forming the clothing system are not limited to particular types. Various processing (for providing water repellency, UV protection, etc., for example) may be performed as required.

(Vents)

Vents are provided for the outerwear and the inner-layer wear to exhibit a ventilation function. Vents may be provided anywhere including, but not particularly limited to, a front part (front side or front body), a back part (back side or back body), a side part (sides of waist or underarm parts), upper arms and the like, in the case of clothing for upper body. In a preferred embodiment, the outerwear may preferably have a vent positioned in a front part thereof, and the inner-layer wear may have a vent in a front part at a position corresponding to the vent of the outerwear, so that the vents are more exposed to air currents or wind from the front, the body temperature quickly goes down, and the sweat quickly dries up. In the case of clothing for lower body, for example, a front part (front side), a side part (sides), and a back part (backside) of thighs or lower legs may have a vent.

If the vents are each to be provided in the respective front parts, the vents should preferably be provided in the front parts except for parts from shoulders to armpits. This is because if a sack or backpack is being carried on the parts from the shoulders to armpits, so that vents, even if provided in these parts, would have a small open area and can provide less ventilation effect, and would also be hard to open and close.

The shape of the vents is not particularly limited and may be, for example, a straight line, a curved line, polygonal, circular, oval, or any irregular shapes. The opening shape of the vents when opened is not particularly limited and may be oval, circular, polygonal, or any irregular shapes. The number of vents per layer should preferably be one or two, but may be more than that, and vents of several types of shapes may be combined. The vents in layers may have the same shape, or different shapes.

Figure 2:
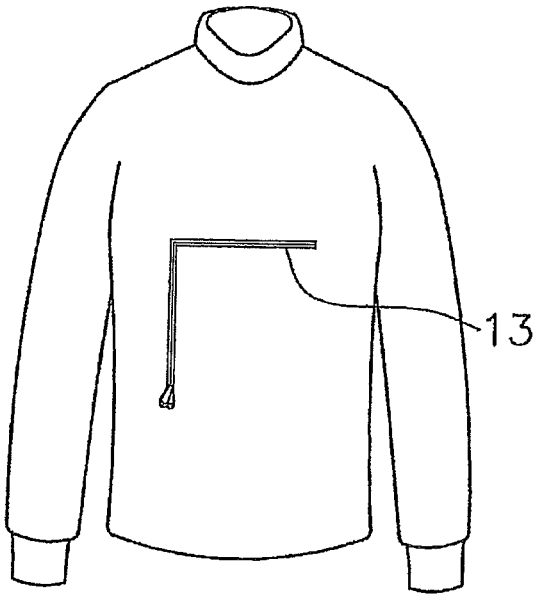
FIG. 2 is a diagram illustrating an example of the shape and position of a vent.
Figure 3:
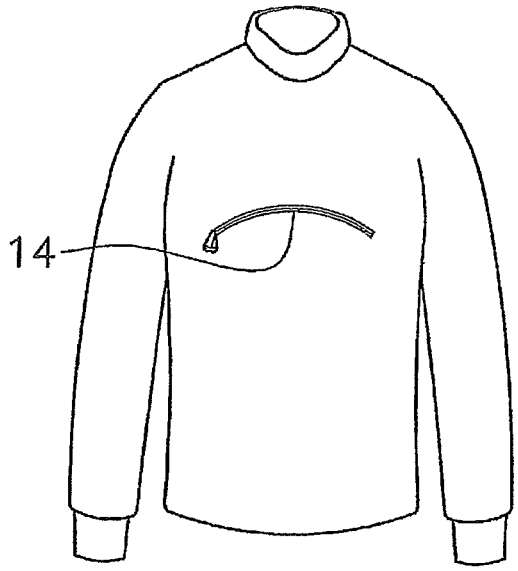
FIG. 3 is a diagram illustrating an example of the shape and position of a vent.
Figure 4:
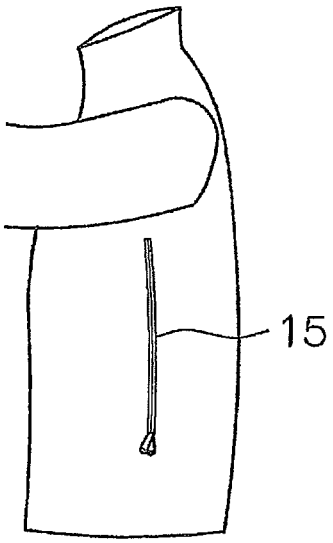
FIG. 4 is a diagram illustrating an example of the shape and position of a vent.
Figure 5:
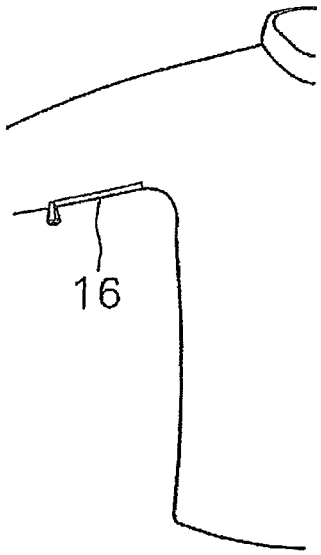
FIG. 5 is a diagram illustrating an example of the shape and position of a vent.
Figure 6:
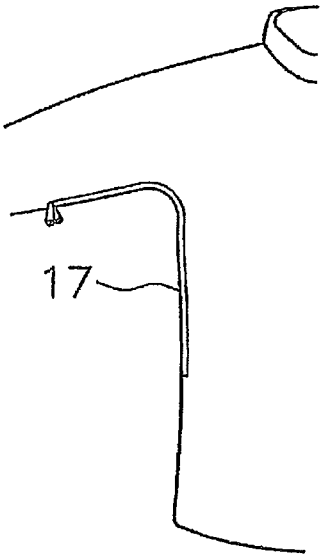
FIG. 6 is a diagram illustrating an example of the shape and position of a vent.
Figure 7:
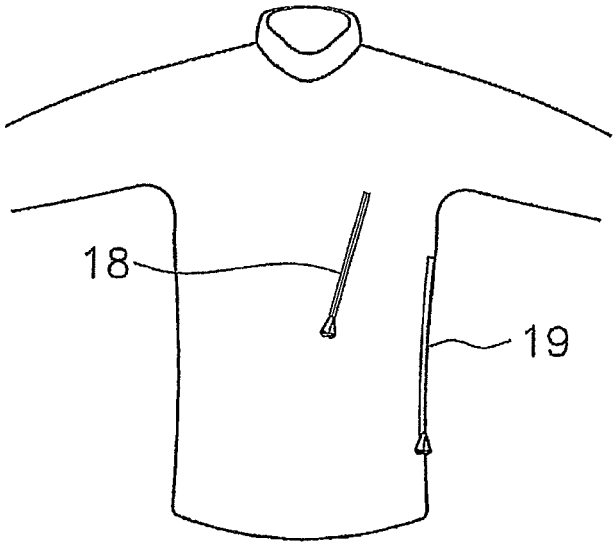
FIG. 7 is a diagram illustrating an example of the shape and position of vents.

FIG. 1 to FIG. 7 illustrate examples of positions of the vents. FIG. 1 shows a pair of vents 11 and 12 extending in an inverted truncated V shape from under the chest toward both sides in the front part. FIG. 2 shows a vent 13 in an inverted L shape in the chest. FIG. 3 shows a vent 14 in an upward circular arc shape in the chest. FIG. 4 shows a linear vent 15 in a side. FIG. 5 shows a linear vent 16 in the lower side of an arm. FIG. 6 shows a linear vent 17 extending from the lower side of an arm to the side via the armpit. FIG. 7 shows a linear vent 18 in the chest and a linear vent 19 in the side. The shape and position of the vents are not limited to the shapes, sizes, and positions shown in FIG. 1 to FIG. 7.

Figure 8:
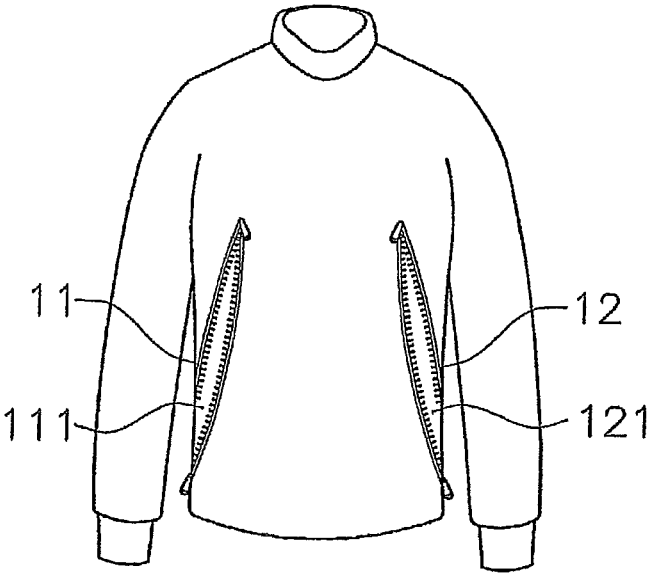
FIG. 8 is a diagram illustrating an example of an open state of vents.
Figure 9:
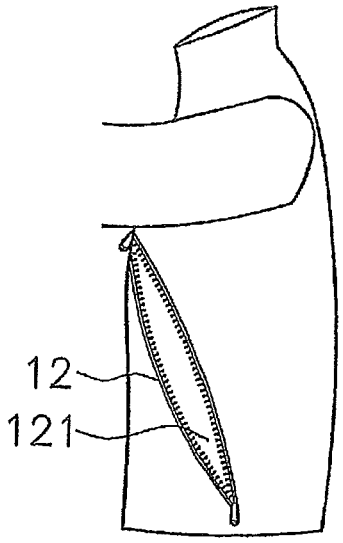
FIG. 9 is a diagram illustrating an example of an open state of a vent.
Figure 10:
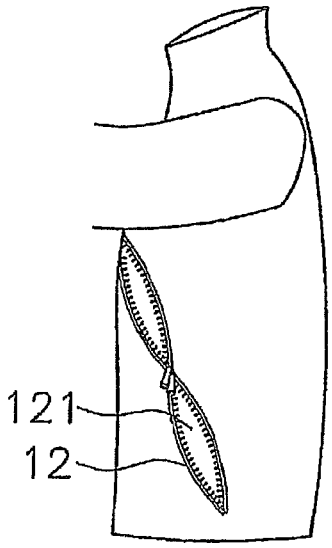
FIG. 10 is a diagram illustrating an example of an open state of a vent.
Figure 11:
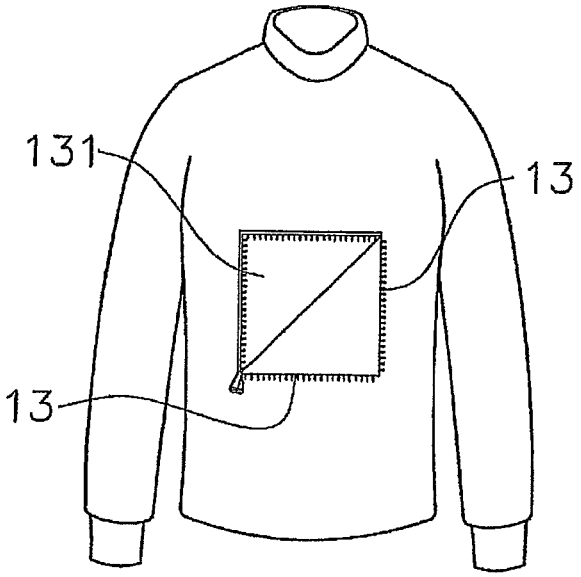
FIG. 11 is a diagram illustrating an example of an open state of a vent.
Figure 12:
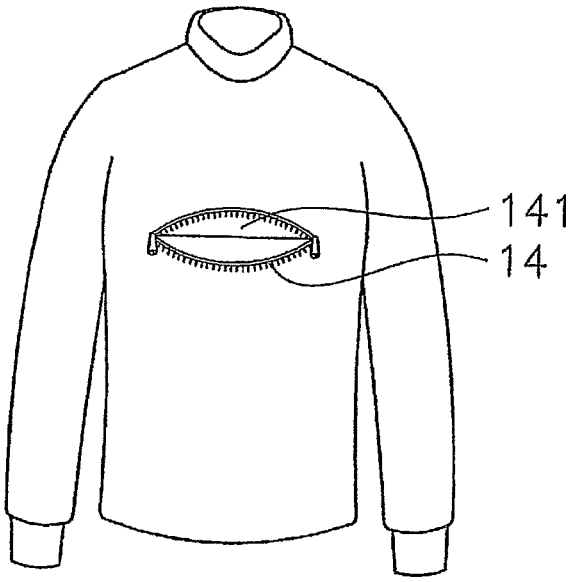
FIG. 12 is a diagram illustrating an example of an open state of a vent.
Figure 13:
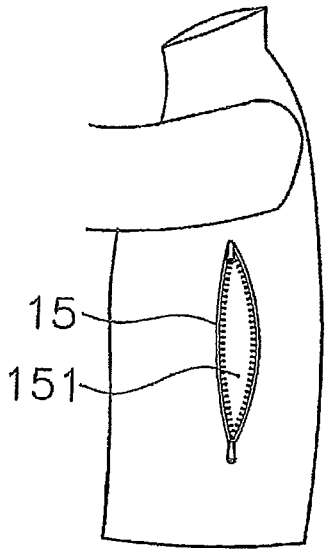
FIG. 13 is a diagram illustrating an example of an open state of a vent.

FIG. 8 to FIG. 13 illustrate examples of open states of the vents of FIG. 1 to FIG. 7. FIG. 8 to FIG. 10 show examples of open states 111 and 121 of the inverted truncated V-shaped vents 11 and 12, FIG. 8 being a front view and FIG. 9 and FIG. 10 being side views. FIG. 10 shows a state in which a central portion is fastened so as to form two openings. FIG. 11 shows one example of an open state 131 of the inverted L-shaped vent 13 in the chest. FIG. 12 shows one example of an open state 141 of the upward circular arc vent 14. FIG. 13 shows one example of a fully opened state 151 of the linear vent 15 in the side. The open states of vents are not limited to those of FIG. 8 to FIG. 13.

Different shapes may be used in combination for vents in the outerwear and inner-layer wear, or in a plurality of inner-layer wears. For example, an inverted truncated V-shaped vent may be employed as the vent in the outerwear, while another inverted truncated V-shaped vent smaller than the one in the outerwear, or a linear vent in the chest, or a linear vent in a side, may be employed as the vent in the mid layer. The inverted truncated V-shaped vent in the outerwear and the linear vent in the chest of the mid layer or the linear vent in the side of the mid layer should preferably be positioned close to each other. Alternatively, the vents in the outerwear and the mid layer should preferably have their openings overlapped upon one another.

Openable fasteners should preferably be used so that the vents can be opened and closed. Examples of such fasteners include common buttons, point fasteners (such as snap buttons), line fasteners (such as zippers), or surface fasteners (such as "Magic Tape®"). Any of these may be used alone, or two or more of these may be used in combination as required. The opening degree of the vents is not limited to be fully open. The vents may be opened partly, or partly closed by a fastener. The openable part of the vents may be configured to be opened and closed so as to utilize friction between the fabrics or designs of the garments, examples including a configuration in which the openable parts are fastened such that the fabrics overlap each other, and a configuration in which one fabric has a tongue while the other fabric has a slit so that the tongue can be inserted into the slit and folded back and fastened.

The vent may also be a mesh or breathable bag member (pocket) or a piece of fabric removably attached as backing or lining, or sewed or otherwise fixedly attached. The vent can exhibit its ventilation function when opened through the bag member or fabric. Also, the vent may function as a pocket.

The vent in the outerwear should preferably be positioned at the same position of, or close to the vent in at least one inner-layer wear when the clothing system is worn. With the respective vents being at the same position or close to each other, their ventilation function can be effectively exploited when the respective vents are open. Wherever the respective vents are positioned, the shape, size, and the like of the vents need not be the same, and the shape, size, and the like of the vents in the open state need not be the same, either. The respective vents should preferably be configured to be opened and closed so as to allow the wearer to select the degrees of opening of the respective vents so that the wearer can maintain, or quickly improve, the moisture and temperature condition inside the garments as desired.

Figure 14:
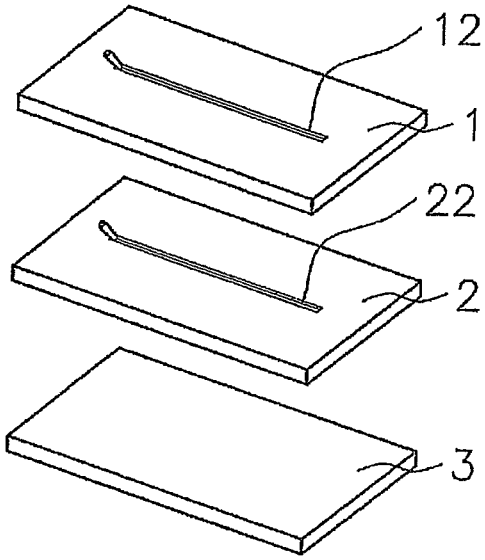
FIG. 14 is a diagram illustrating an example of a layered state.
Figure 15:
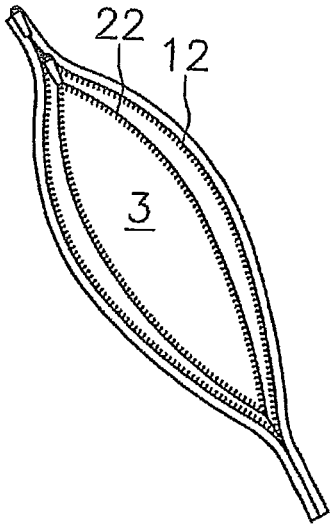
FIG. 15 is a diagram illustrating an example of a layered state.

FIG. 14 and FIG. 15 illustrate an example of layering of an outerwear 1 as the outermost layer, a mid layer 2 as the intermediate layer, and a base layer 3 directly contacting the skin. As shown in FIG. 14, the outerwear 1 includes a pair of inverted truncated V-shaped vents 12 (only one of the pair being shown in FIG. 14), and the mid layer 2 similarly includes a pair of inverted truncated V-shaped vents 22 (only one of the pair being shown in FIG. 14). Both vents have a line fastener (zipper) as a fastener. FIG. 15 shows the vents 12 and 22 in the outerwear 1 and the mid layer 2 in an open state, with the three types of clothing noted above worn in layers.

For better ventilation performance, an inner-layer wear having a vent directly below the vent in the outerwear should preferably be worn. The vents should preferably be provided to garments made of a waterproof, windproof, and low moisture-permeable or low breathable fabric. Another garment (inner-layer wear) having moisture permeability and/or breathability may be worn between the outerwear having a vent and the inner-layer wear having a vent. The base layer directly contacting the skin may not necessarily include an openable vent and may be made of a moisture-permeable and/or breathable fabric.

The position of the vent in the inner-layer wear should preferably be determined such that it can be opened and closed by opening the vent in the outerwear when both garments are worn. That is, the wearer can open the vent in the outerwear and insert his/her hand into the opening to open the vent in the inner-layer wear, so that the vent in the inner-layer wear can be opened and closed simply and quickly without taking off the outerwear.

EXAMPLES

Two types of base layers, two types of mid layers, and an outerwear, i.e., a total of five types of clothing were worn in layers, and both the temperature and moisture were measured to evaluate the ventilation performance in each of the conditions where all the vents in the two types of mid layers and the outerwear were fully open (Example 1), where only the vent in the outerwear was fully open (Comparative Example 1), and where the vents were fully closed (Comparative Example 2).

A thermal manikin was dressed with a first base layer processed to have a water repellent side on the skin ("DRY LAYER®", 100% polyester, by finetrack Co., Ltd.) and a second base layer capable of wicking sweat away, retaining heat, and adjusting moisture ("BASE LAYER", 17% wool, 83% polyester, by finetrack Co., Ltd.) over the first base layer, as the base layer. The manikin was then dressed with a first mid layer capable of wicking sweat away and retaining heat ("MIDDLE LAYER", 100% polyester, by finetrack Co., Ltd.) over the base layer, and further with a windproof, heat-retaining, and moisture-permeable second mid layer ("mid shell®", outer: 100% polyester, lining: 100% polyester laminated with a waterproof moisture-permeable film by finetrack Co., Ltd.) thereon, as the mid layer. The manikin was further dressed with a thermal, windproof, and waterproof outerwear ("OUTER SHELL", outer: 100% nylon, lining: 100% polyester laminated with a waterproof moisture-permeable film by finetrack Co., Ltd.) over the mid layer. The vents were both inverted truncated V-shaped vents extending from under the chest to the sides as shown in FIG. 1, with zippers as fasteners, and designed to have the same opening size.

(Measurement Condition)

The surface temperature of the thermal manikin was set to 36° C., while the ambient temperature around the manikin was set to 10° C., with wind blowing toward the front part of the manikin at a speed of 2 m/sec. The water content of the second base layer was adjusted to 100% (the water content indicating the maximum amount of moisture the entire clothing system can absorb).

(Comparison of Humidity (Heat and Moisture) Reduction Effect)

A hygrometer was inserted between the first base layer and the second base layer, and the humidity was measured at a timing when the measurements became substantially steady (about 15 minutes later). The results were 63.0% RH in Example 1 with all the vents fully open, 77.0% RH in Comparative Example 1 with only the vent in the outerwear fully open, and 88.3% RH in Comparative Example 2 with all the vents closed. The humidity was reduced more in Example 1 than Comparative Example 1 by 14%, which confirmed that heat and moisture were removed more quickly to achieve a comfortable condition inside the clothing in Example 1 as compared to Comparative Example 1.

(Comparison of Temperature Reduction Effect)

A thermometer was inserted between the second base layer and the first mid layer, and the temperature was measured at a timing when the measurements became substantially steady (about 15 minutes later). The results were 19.1° C. in Example 1 with all the vents fully open, 23.7° C. in Comparative Example 1 with only the vent in the outerwear fully open, and 27.0° C. in Comparative Example 2 with all the vents closed. The temperature was reduced in Example 1 than in Comparative Example 1 by 4.6° C., which confirmed that the temperature that is felt hot could be quickly reduced to a temperature that is felt comfortable during exercise in Example 1 as compared to Comparative Example 1.

DESCRIPTION OF REFERENCE SIGNS

1 outerwear
2 mid layer
3 base layer
11, 12 inverted truncated V-shaped vent
111, 121 open state of inverted truncated V-shaped vent

What is claimed is:

1. A clothing layering system for layering comprising five different types of clothing, namely:

a first base layer interior side directly contacting skin;

a second base layer worn over said first base layer and designed for wicking sweat away, retaining heat and adjusting moisture;

a first inner layer worn over said second base layer, and designed for wicking sweat away and retaining heat;

a windproof, heat-retaining and moisture-permeable second inner layer worn over said first inner layer; and a windproof and waterproof outerwear worn over said second inner layer;

wherein said outerwear comprises one or more than one vent that designed for being opened and closed, said second inner-layer comprises one or more than one vent that designed for being opened and closed, said first inner-layer comprises one or more than one vent that designed for being opened and closed, said vent of said outerwear, said vent of said second inner-layer, said vent of said first inner-layer and said vent of said second base layer are positioned so as to coincide with or close each other when said clothing layering system is worn, and said first base layer directly contacting skin does not comprise a vent that designed for being opened and closed, wherein said vent of said second inner-layer, and said vent of said first inner-layer are designed for being opened and closed through said vent of said outer layer when said clothing layering system is worn, depending on use environment, and said skin is protected by said first base layer when said vent of said outerwear, said vent of said second inner-layer, and said vent of said first inner-layer are opened.

2. The clothing layering system according to claim 1, wherein said vent of said outerwear, said vent of said second inner-layer and said vent of said first inner-layer are positioned in a front part thereof.

3. The clothing layering system according to claim 1, wherein said vent of said outerwear and said vent of said second inner-layer and said vent of said first inner-layer are positioned in said front part thereof except for portions of armpits.

4. The clothing layering system according to claim 1, wherein the first base layer comprises a water-repellant function.

5. A clothing layering system for layering comprising four different types of clothing, namely:

a base layer interior side directly contacting skin;

a first inner layer worn over said base layer, and capable of wicking sweat away and retaining heat;

a windproof, heat-retaining and moisture-permeable second inner layer worn over said first inner layer; and a windproof and waterproof outerwear worn over said second inner layer;

wherein said outerwear comprises one or more than one vent that designed for being opened and closed, said second inner-layer comprises one or more than one vent that designed for being opened and closed, said first inner-layer comprises one or more than one vent that designed for being opened and closed, said vent of said outerwear, said vent of said second inner-layer, and said vent of said first inner are positioned so as to coincide with or close to each other when said clothing layering system is worn, and said base layer directly contacting skin does not comprise a vent that designed for being opened and closed, wherein said vent of said second inner-layer, and said vent of said first inner-layer are designed for being opened and closed through said vent of said outer layer when said clothing layering system is worn, depending on use environment, and said skin is protected by said base layer when said vent of said outerwear, said vent of said second inner-layer, said vent of said first inner-layer are opened.

6. The clothing layering system according to claim 5, wherein said base layer comprises function of a water repellant.

7. The clothing layering system according to claim 5, wherein said vent of said outerwear, said vent of said second inner-layer and said vent of said first inner-layer are positioned in a front part thereof.

8. The clothing layering system according to claim 5, wherein said vent of said outerwear and said vent of said second inner-layer and said vent of said first inner-layer are positioned in said front part thereof except for portions of armpits.

* * * * *